US007246593B2

(12) United States Patent
Murphy

(10) Patent No.: US 7,246,593 B2
(45) Date of Patent: Jul. 24, 2007

(54) INTAKE MODULE ASSEMBLY

(75) Inventor: Kevin A. Murphy, Sterling Heights, MI (US)

(73) Assignee: Siemens Canada Limited, Chatham (CA)

( * ) Notice: Subject to any disclaimer, the term of this patent is extended or adjusted under 35 U.S.C. 154(b) by 299 days.

(21) Appl. No.: 10/644,440

(22) Filed: Aug. 20, 2003

(65) Prior Publication Data

US 2004/0040527 A1 Mar. 4, 2004

Related U.S. Application Data

(60) Provisional application No. 60/406,820, filed on Aug. 29, 2002.

(51) Int. Cl.
*F02M 35/10* (2006.01)

(52) U.S. Cl. ..... 123/184.57

(58) Field of Classification Search ..... 123/184.21–184.61
See application file for complete search history.

(56) References Cited

U.S. PATENT DOCUMENTS 5,477,819 A * 12/1995 Kopec ..... 123/184.42
5,575,247 A * 11/1996 Nakayama et al. .... 123/184.21
5,642,697 A * 7/1997 Jahrens et al. ..... 123/184.21
5,769,045 A * 6/1998 Edwards et al. ..... 123/184.61
5,896,838 A * 4/1999 Pontopiddan et al. .. 123/184.47
5,992,369 A * 11/1999 Mehne ..... 123/184.21
6,085,712 A * 7/2000 Ma ..... 123/184.42
6,092,499 A * 7/2000 Spannbauer ..... 123/184.61
6,189,521 B1 * 2/2001 Hancock ..... 123/572
6,273,048 B1 * 8/2001 Kargilis ..... 123/184.57
6,321,708 B1 * 11/2001 Wehner et al. ..... 123/184.61
6,666,182 B2 * 12/2003 Schermuly et al. .... 123/184.55
6,752,115 B2 * 6/2004 Fiesel et al. ..... 123/184.42
6,830,024 B2 * 12/2004 Kodweiss et al. ..... 123/184.53

* cited by examiner

*Primary Examiner*—Marguerite McMahon
(74) *Attorney, Agent, or Firm*—Carlson, Gaskey & Olds, P

(57) ABSTRACT

An intake module assembly for a vehicle engine is formed from a two-piece shell structure. First and second shells are aligned and joined together to form the entire air path from an air filter to an engine cylinder head. A throttle hose portion is formed as part of at least one of the first or second shells to conduct air to the throttle body and into the intake manifold. Other induction components such as an intake manifold, resonator, air filter holder, and throttle body components are also integrated into the first and second shells.

31 Claims, 6 Drawing Sheets

INTAKE MODULE ASSEMBLY

CROSS-REFERENCE TO RELATED APPLICATIONS

The application claims priority to U.S. Provisional Application No. 60/406,820, which was filed on Aug. 29, 2002.

BACKGROUND OF THE INVENTION

This invention relates to an intake module assembly for a vehicle engine that forms a complete air path from an air filter to an engine cylinder head within a two-piece shell structure.

Air intake or induction systems are used to conduct air to internal combustion engines. The use of air induction systems has resulted in the need for additional vehicle system components to compensate for certain undesirable side effects generated by the connection of air induction components to the vehicle engine. For example, engine noise is propagated back through the air induction components, which is undesirable. To address this problem, noise attenuation components, such as resonators, have been utilized to reduce these noises.

Another undesirable side effect introduced by air induction components, is that the air that is drawn into the air induction system includes dust, dirt, and other particulate contaminants. These contaminants can clog the engine resulting in poor performance. Air cleaners with filters are used to remove these contaminants from the airflow prior to the air being drawn into the engine.

Further, other components, such as an intake manifold, air duct hoses, throttle components, etc., must also be incorporated into the induction system to achieve proper engine control and function. These components are traditionally separately formed and attached to each other prior to being attached to a vehicle engine, or certain induction components are first mounted to a vehicle engine with additional components being subsequently attached either to the engine or other induction components as required.

The use of these multiple induction components increases material and manufacturing costs. Further, the assembly of the additional components into the air induction system and/or onto the vehicle engine is time consuming and labor intensive. Thus, it is the object of the present invention to provide a simplified intake module assembly that reduces the overall number of required components, and which can be easily assembled, as well as overcoming the other above-mentioned deficiencies with the prior art.

SUMMARY OF THE INVENTION

An intake module assembly utilizes a two-piece shell structure to form an air path extending from an air filter to an engine cylinder head. A first shell forms a first portion of the air path and a second shell forms a second portion of the air path. A throttle hose portion is supported on at least one of the first or second shells to form a third portion of the air path. The first and second shells are joined together such that the first, second, and third portions together completely form the air path.

The throttle hose portion can be integrally formed as part of the first and/or second shells or can be separately attached to one or both of the shells. The throttle hose portion conducts air to the engine throttle body and into the intake manifold.

In one disclosed embodiment, multiple induction components are formed as part of the first and second shells. Components such as the intake manifold, resonators, and air filter holder are integrally formed within the first and second shells. Once the shells are joined together to form the intake module assembly, the assembly is easily mounted to the vehicle engine at the cylinder head.

The subject invention provides an improved intake module assembly that reduces the number of required components, resulting in decreased material, manufacturing, and assembly costs. These and other features of the present invention can be best understood from the following specifications and drawings, the following of which is a brief description.

DETAILED DESCRIPTION OF A PREFERRED EMBODIMENT

Figure 1:
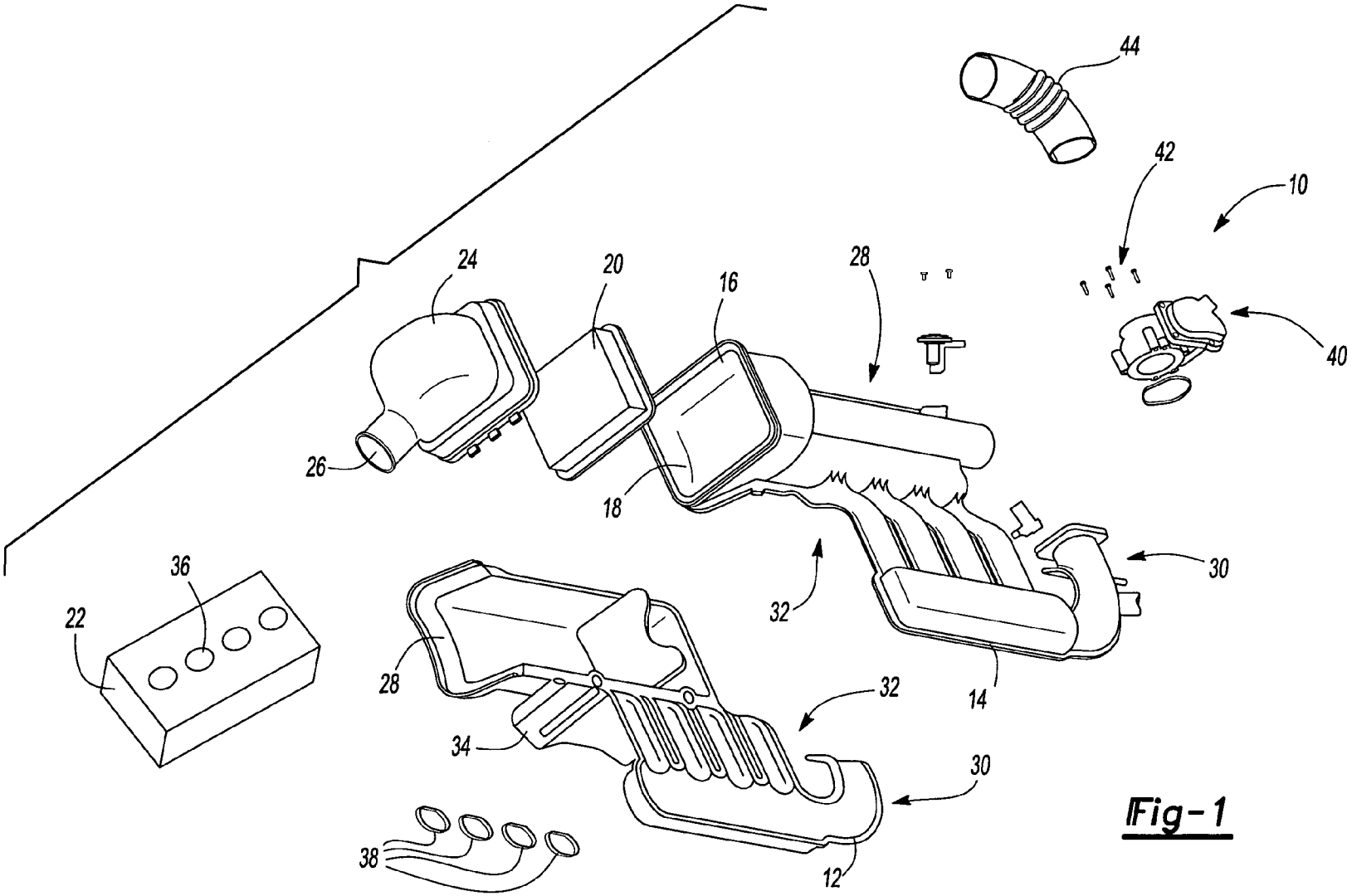
FIG. 1 is an exploded view of an intake module assembly incorporating the subject invention.

An intake module assembly, shown generally at 10 in FIG. 1, includes a lower shell 12 forming a first portion of an induction air path and an upper shell 14 forming a second portion of the induction air path. An air filter support 16 and air filter chamber 18 are formed within the upper shell 14. An air filter 20 is installed within the chamber 18 to remove contaminants from the air prior to entry of the air into a vehicle engine 22. A filter cover 24 is mounted to the upper shell 14 to enclose the air filter 20 within the chamber 18. The cover 24 includes an inlet air duct 26 that draws air in from the external atmosphere.

The lower 12 and upper 14 shells each include at least one resonator portion 28, a zip tube portion 30, and an intake manifold portion 32. When the shells 12, 14 are aligned and joined together, a complete resonator 28 and intake manifold 32 are formed solely between the shells 12, 14. This will be discussed in greater detail below. The shells 12, 14 are preferably formed from molding materials and by using molding processes that are well known in the art.

The lower shell 12 includes a mounting interface 34 for attachment to a cylinder head portion 36 of the vehicle engine 22. Sealing rings 38 are also installed at the mounting interface 34, as is known in the art.

A throttle body 40 is mounted to at least one of the upper 14 or lower 12 shells with a plurality of fasteners 42. A connecting throttle hose portion 44 is used to conduct air exiting from the resonator chamber portions 28 to the throttle body 40. The throttle hose portion 44 is either integrally molded with the upper shell 14 or can be separately attached to the shell 14 by welding or other similar attachment methods.

Air flows through the inlet air duct 26, through the filter 20, through the resonator 28 and into the throttle hose portion 44. Air then flows through the throttle body 40 into the zip tube portions 30, into the intake manifold 32, and finally into the vehicle engine 22 at the cylinder head 36. Thus, the entire air path from the air filter 20 to the engine cylinder head 36 is formed within the upper 14 and lower 12 shells with zip tube and throttle hose portions 30, 44.

Figure 2A:
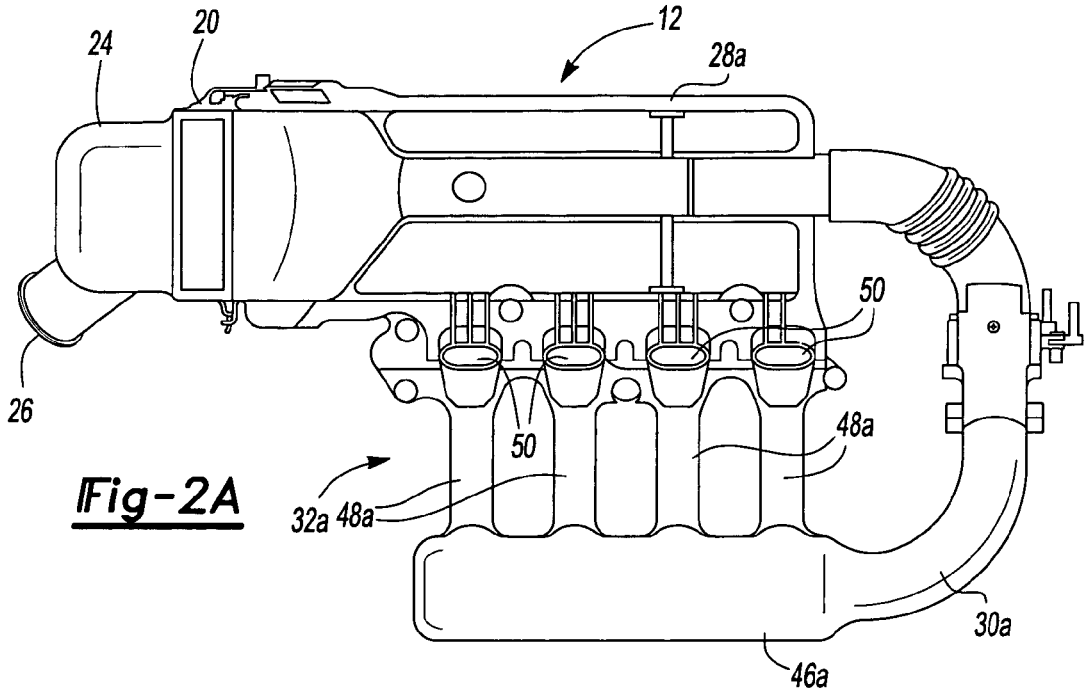
FIG. 2A is a side view of a lower shell of the intake module assembly of FIG. 1.
Figure 2B:
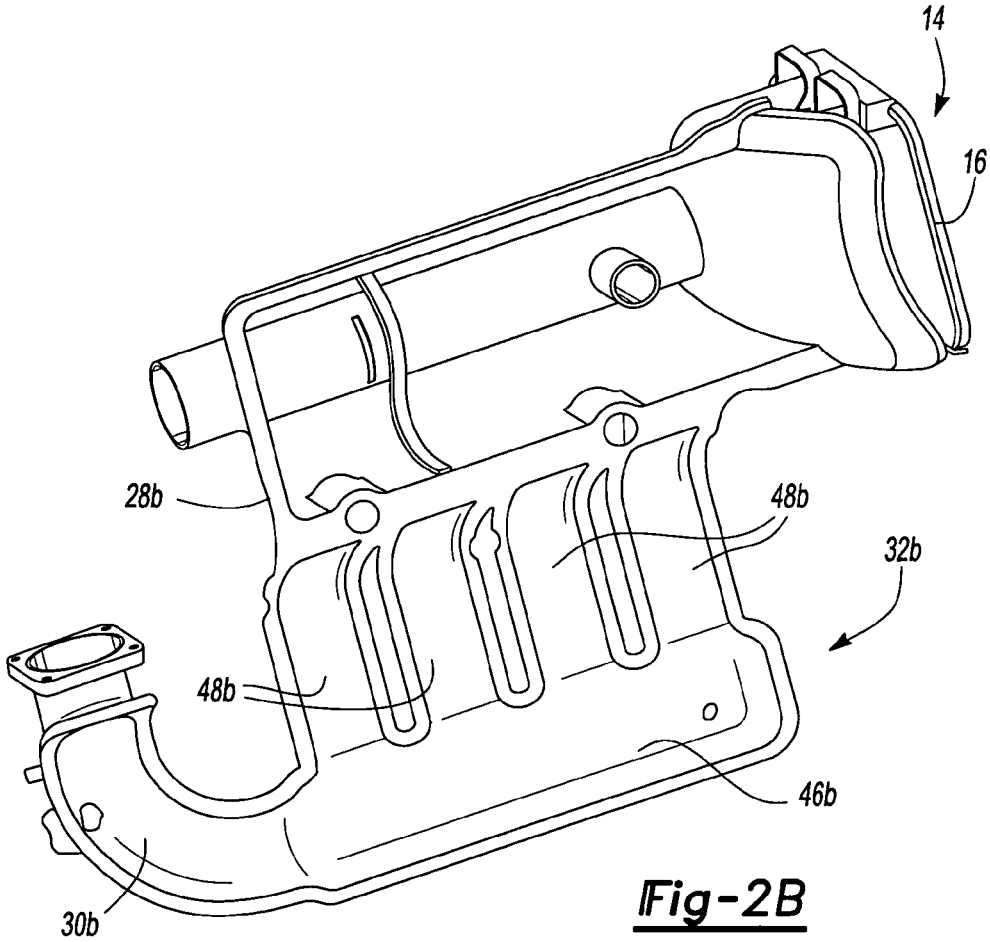
FIG. 2B is a side view of an upper shell of the intake module assembly of FIG. 1.

As shown in FIG. 2A, the lower shell 12 includes a first intake manifold portion 32*a* that includes a main intake chamber portion 46*a* and a plurality of runner portions 48*a*. The lower shell 12 includes openings 50 that conduct air from the runners 48*a* into the engine cylinder head 36. The lower shell 12 also includes a resonator chamber portion 28*a* that is used to attenuate undesirable noises generated during engine operation. A zip tube portion 30*a* is also formed as part of the lower shell 12.

Figure 3A:
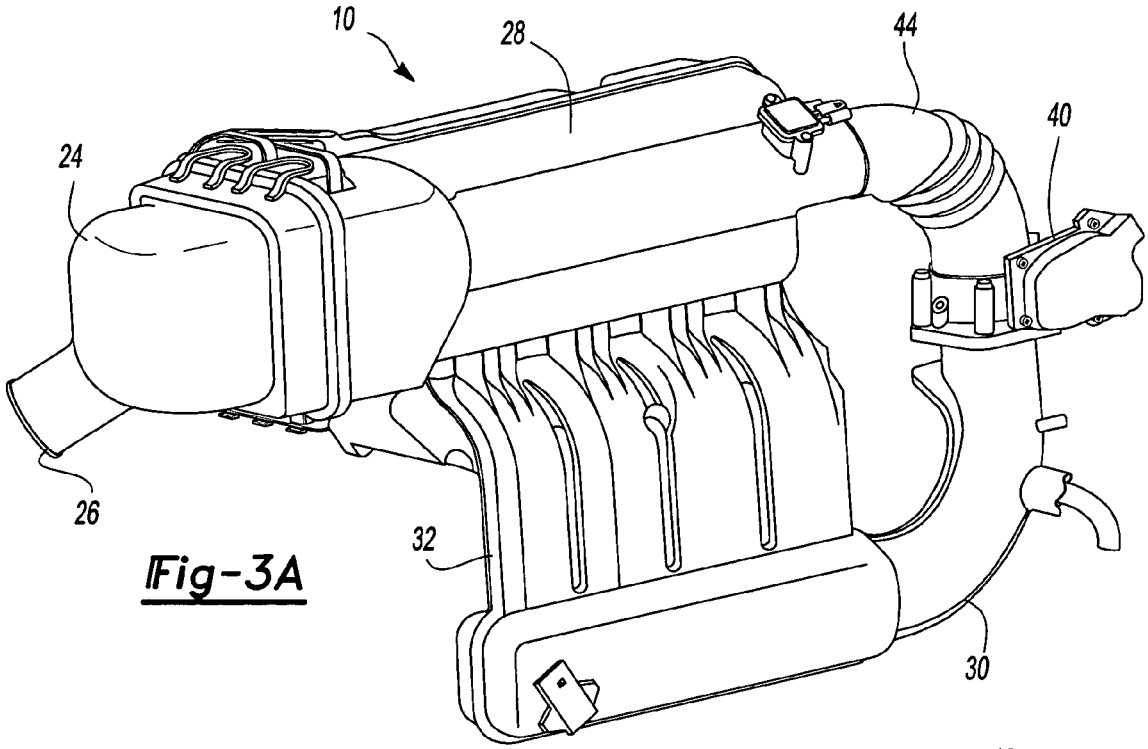
FIG. 3A is a first perspective view of the assembled intake module assembly of FIG. 1.
Figure 3B:
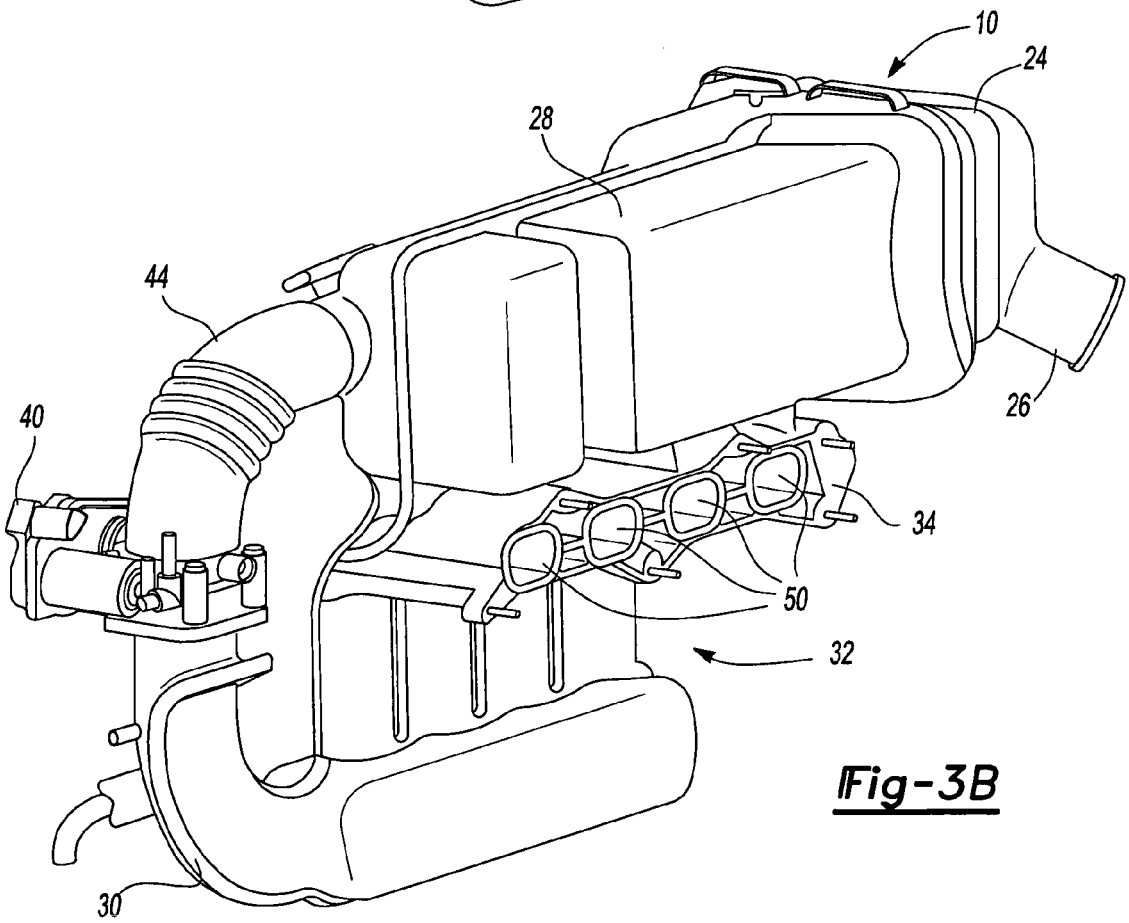
FIG. 3B is a second perspective view of the assembled intake module assembly of FIG. 1.

The upper shell 14 includes a second intake manifold portion 32*b* with a main intake chamber portion 46*b* and a plurality of runner portions 48*b*. When assembled, the first 32*a* and second 32*b* intake manifold portions are aligned and joined to form the intake manifold 32 (see FIG. 3A). The upper shell 14 also includes a resonator chamber portion 28*b* and a zip tube portion 30*b* that are aligned and joined with the resonator chamber portion 28*a* and zip tube portion 30*a* of the lower shell 12 to form the resonator 28 and zip tube 30 (see FIGS. 3A and 3B).

Figure 4:
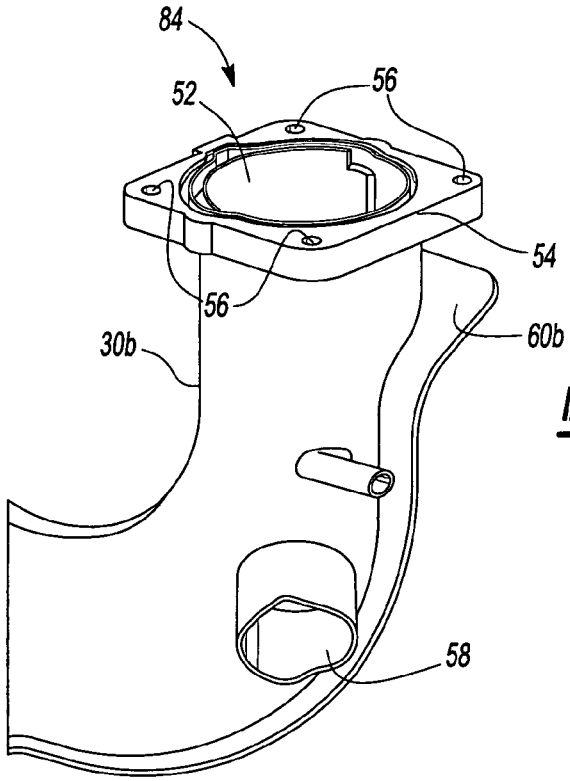
FIG. 4 is a perspective view, partially broken away, of a tube portion of the upper shell of FIG. 2B.

The zip tube portion 30*b* of the upper shell 14 includes a mounting interface 84 for the throttle body 40, shown in FIG. 4. The mounting interface 84 includes a circular opening 52 surrounded by a mounting flange 54, which includes a plurality of openings 56. The fasteners 42 are received within the openings 56 to attach the throttle body 40 to the intake module assembly 10. An exhaust gas re-circulation (EGR) port 58 is also formed in the zip tube portion 30*b* of the upper shell 14. An EGR system (not shown) conducts exhaust gases from an exhaust source back into the intake manifold 32, as is known in the art.

Figure 5:
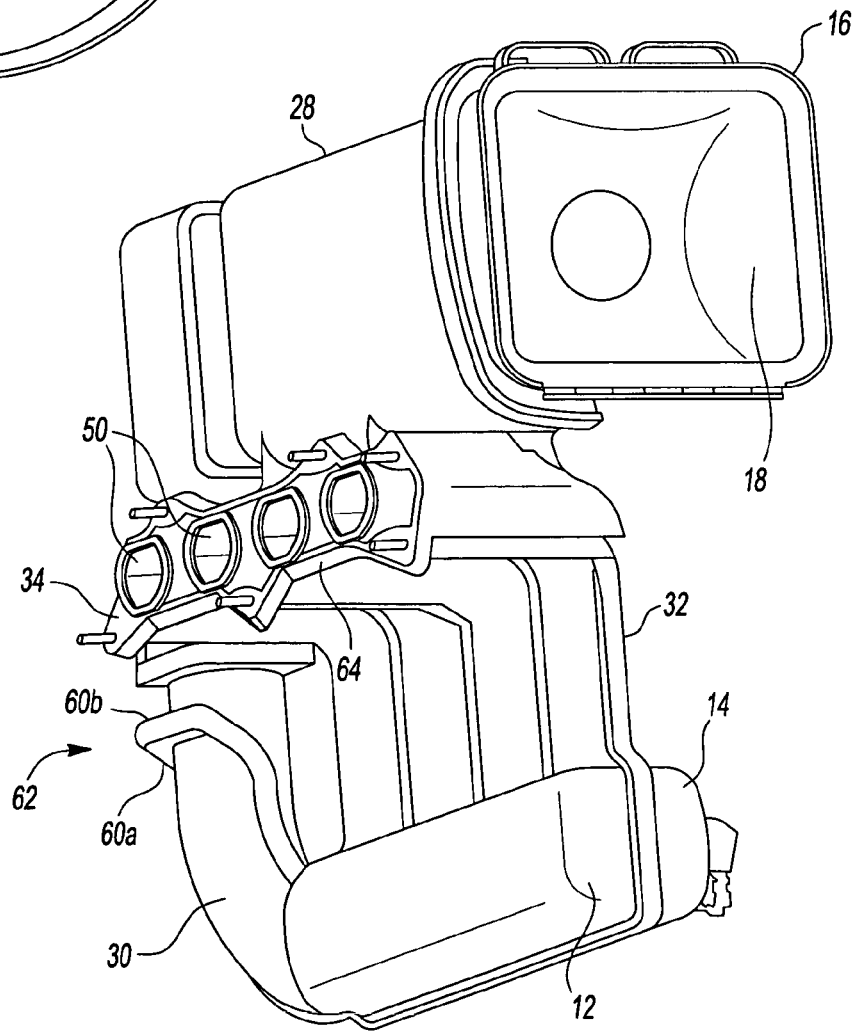
FIG. 5 is a perspective view of the upper and lower shells of FIGS. 2A and 2B as assembled.

The zip tube portions 30*a*, 30*b* each include a wide span flange 60*a*, 60*b*. The flanges 60*a*, 60*b* are aligned at a zip tube attachment joint 62. The flanges 60*a*, 60*b* provide increased rigidity and structural integrity at the attachment joint 62, as shown in FIG. 5. A structural flange 64, also shown in FIG. 5, is formed on the lower shell 12 at the mounting interface 34 to the vehicle engine 22. The flange 64 is formed underneath the openings 50 that communicate with the cylinder head 36. The flange 64 is formed with high rigidity in the lower shell 12 for attachment to the cylinder head 36 with fasteners (not shown) having a locking compound. The benefit of this configuration is that compression limiters are not required.

Figure 6:
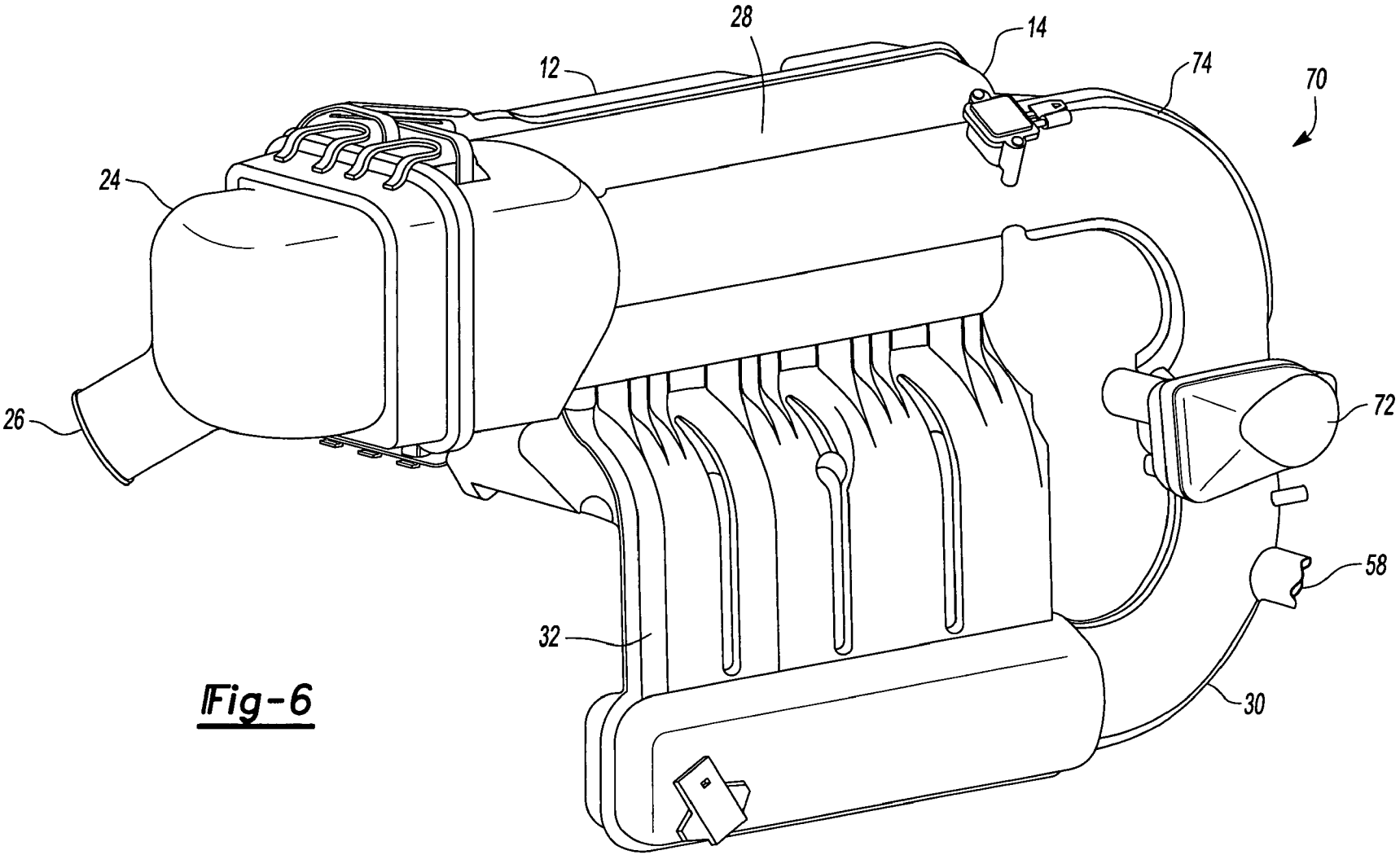
FIG. 6 is an assembled perspective view of an alternate embodiment of an intake module assembly incorporating the subject invention.
Figure 8:
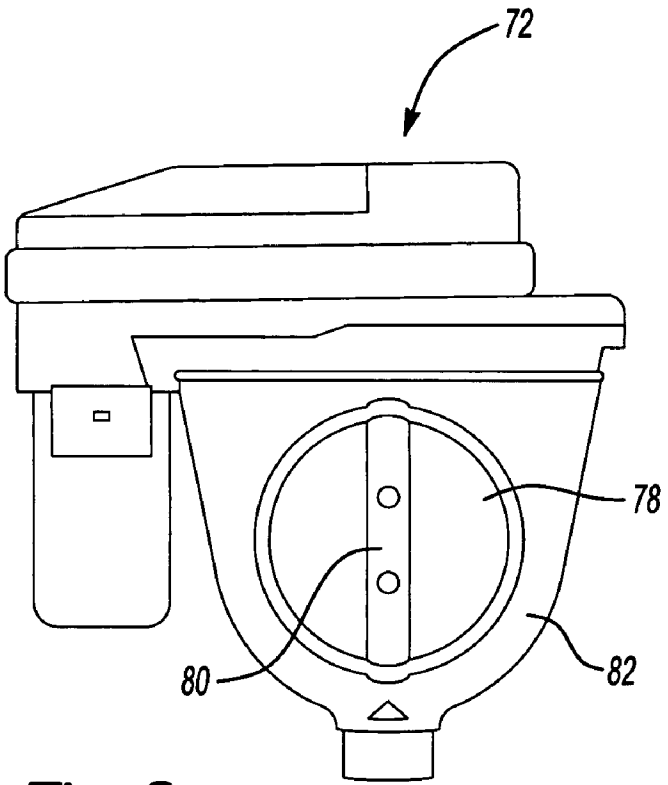
FIG. 8 is a top view of a throttle body portion of the embodiment of FIG. 6.
Figure 7:
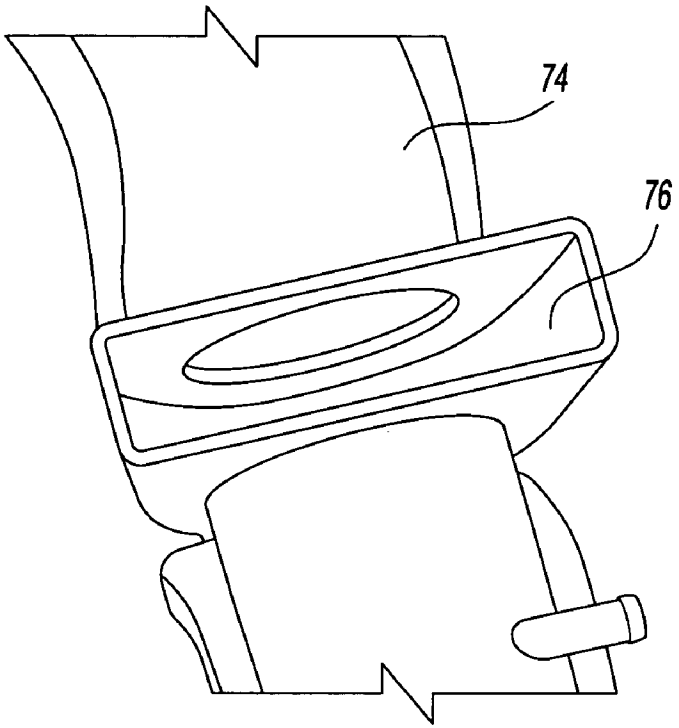
FIG. 7 is a side view of a tube portion of the embodiment of FIG. 6.

An alternate embodiment of an intake module assembly 70 is shown in FIGS. 6-8. This intake module assembly 70 is similar to the intake module assembly 10 discussed above, but includes an integral throttle 72. In this embodiment, the throttle hose 74 is formed as part of the upper shell 14. It should be understood that this integral throttle hose 74 could also be used in the intake module assembly 10 shown in FIGS. 1-5.

The throttle hose 74 includes an opening 76, shown in FIG. 7, into which the throttle 72 is inserted and retained in place. The throttle 72 is a module that includes a throttle blade 78 and support shaft 80, which are positioned in an opening 82 formed within the throttle 72.

The subject invention provides an improved modular assembly for an engine intake system that reduces the number of required components, and decreases material, manufacturing, and assembly costs. Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An intake module assembly for a vehicle engine comprising:

an air path adapted to extend from an air filter to an engine cylinder head;

a first single-piece shell forming a first portion of said air path;

a second single-piece shell forming a second portion of said air path;

a plenum and at least one resonator seperate from said plenum, said plenum and said resonator each completely and integrally formed as part of said first and second single-piece shells; and a throttle hose portion supported on at least one of said first or second single-piece shells forming a third portion of said air path wherein said first and second single-piece shells are joined together such that said first, second, and third portions together completely form said air path.

2. The assembly of claim 1 wherein said first and second single-piece shells are welded together.

3. The assembly of claim 1 including an intake manifold integrally and solely formed as part of said first and second single-piece shells, said intake manifold fluidly connected to said resonator via said throttle hose portion.

4. The assembly of claim 1 including a throttle body attached to at least one of said first and second single-piece shells.

5. The assembly of claim 1 wherein one of said first or second single-piece shells includes a rigid flange defining a mounting interface for attachment to the engine cylinder head.

6. The assembly of claim 1 wherein one of said first or second single-piece shells includes a first zip tube portion including an exhaust gas re-circulation port and said other of said first or second single-piece shells includes a second zip tube portion that aligns with said first zip tube portion at a zip tube joint to form a zip tube.

7. The assembly of claim 6 wherein said first and second zip tube portions each include a transversely extending flange formed at said zip tube joint to increase tube rigidity.

8. The assembly of claim 1 wherein said throttle hose portion is integrally formed as part of at least one of said first or second single-piece shells.

9. An intake module assembly for a vehicle engine comprising:

an air path adapted to extend from an air filter to an engine cylinder head;

a first shell forming a first portion of said air path;

a second shell forming a second portion of said air path;

at least one resonator integrally formed as part of said first and second shells;

an intake manifold integrally and solely formed as part of said first and second shells; and a throttle hose portion supported on at least one of said first or second shells forming a third portion of said air path wherein said first and second shells are joined together such that said first, second, and third portions together completely form said air path and wherein air is adapted to flow from said air filter through said resonator, from said resonator into said throttle hose portion, from said throttle hose portion into said intake manifold, and then out to the engine cylinder head.

10. The assembly of claim 9 including an air filter support integrally and solely formed as part of said first and second shells.

11. The assembly of claim 10 including a throttle hose integrally and solely formed as part of said first and second shells.

12. The assembly of claim 11 including a throttle body portion integrally formed as part of said first and second shells.

13. The assembly of claim 9 wherein air is adapted to flow from said throttle hose portion into a zip tube and then flow from said zip tube into said intake manifold.

14. A method for forming an intake module assembly comprising the steps of:

aligning a first single-piece shell with a second single-piece shell to form a complete air path from an inlet from an air filter to an outlet for an engine cylinder head;

integrally and completely forming a plenum at least one resonator separate from said plenum, each being formed as part of the first and second single-piece shells; and joining the first and second single-piece shells together.

15. The method of claim 14 including the step of forming a throttle hose on at least one of the first or second single-piece shells to form a portion of the air path.

16. The method of claim 14 including the step of integrally forming an intake manifold as part of the first and single-piece second shells with the resonator being in fluid communication with the intake manifold via a throttle hose.

17. The method of claim 14 including the step of integrally forming an air filter support as part of the first and second single-piece shells.

18. The method claim 14 including the step of integrally forming a throttle body portion as part of the first and second single-piece shells.

19. The method of claim 14 including the step of separately attaching a throttle body to at least one of the first and second single-piece shells.

20. An intake module assembly for attachment to a vehicle engine comprising:

an air path extending from an inlet from an air filter to an outlet adapted for communication with an engine cylinder head;

a first single-piece shell;

a second single-piece shell joined to said first single-piece shell to form the air path; and a plenum and a separate resonator each being solely formed within said first and second single-piece shells wherein air is adapted to flow from said inlet through said resonator to said outlet.

21. The assembly of claim 20 wherein said first and second single-piece shells completely and solely form the air path.

22. The assembly of claim 20 including an intake manifold formed within said first and second single-piece shells wherein air is adapted to flow from said resonator into said intake manifold.

23. The assembly of claim 22 including a throttle hose supported by at least one of said first and second single-piece shells wherein air is adapted to flow from said resonator through said throttle hose and into said intake manifold.

24. The assembly of claim 23 wherein said throttle hose is integrally formed as part of said first and second single-piece shells.

25. The assembly of claim 23 including a throttle body formed within said first and second single-piece shells wherein air is adapted to flow from said throttle hose into said throttle body.

26. The assembly of claim 25 including a zip tube formed within said first and second single-piece shells wherein air is adapted to flow from said throttle body into said zip tube and then into said intake manifold.

27. The assembly of claim 26 wherein said zip tube includes an exhaust gas re-circulation port.

28. The assembly of claim 26 including an air filter support integrally formed as part of at least one of said first and second single-piece shells.

29. The assembly of claim 26 wherein said resonator, said intake manifold, and said throttle body are all integrally formed within said first and second single-piece shells.

30. An intake module assembly for attachment to a vehicle engine comprising:

an air path extending from an inlet from an air filter to an outlet adapted for communication with an engine cylinder head;

a first shell;

a second shell joined to said first shell to form said air path;

a plenum and a separate resonator each integrally formed as part of said first and second shells;

an intake manifold integrally formed as part of said first and second shells; and a throttle hose portion supported on at least one of said first and second shells forming a portion of said air path between said resonator and said intake manifold.

31. The assembly of claim 30 wherein said first and said second shells each comprise a single piece component, with said first and second shells being joined together to completely form the air path extending from the inlet to the outlet.

* * * * *